US011964323B2

(12) United States Patent
Hentschel et al.

(10) Patent No.: US 11,964,323 B2
(45) Date of Patent: Apr. 23, 2024

(54) THREE-PLATE PRESSURE DIE CASTING MOLD HAVING IMPROVED SPRUE SEPARATION, AND METHOD FOR PRESSURE DIE CASTING (II)

(71) Applicant: Bayerische Motoren Werke Aktiengesellschaft, Munich (DE)

(72) Inventors: Olaf Hentschel, Kumhausen (DE); Andre Schaefer, Rottenburg a.d.Laaber (DE); Manfred Tremmel, Niederaichbach (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 18/028,990

(22) PCT Filed: Aug. 23, 2021

(86) PCT No.: PCT/EP2021/073229
§ 371 (c)(1),
(2) Date: Mar. 28, 2023

(87) PCT Pub. No.: WO2022/069110
PCT Pub. Date: Apr. 7, 2022

(65) Prior Publication Data

US 2023/0330746 A1 Oct. 19, 2023

(30) Foreign Application Priority Data

Sep. 29, 2020 (DE) ..... 10 2020 125 342.7

(51) Int. Cl.
*B22D 17/22* (2006.01)
*B22D 17/20* (2006.01)

(52) U.S. Cl.
CPC ..... *B22D 17/2236* (2013.01); *B22D 17/2076* (2013.01); *B22D 17/2272* (2013.01)

(58) Field of Classification Search
CPC .... B22D 17/20; B22D 17/2076; B22D 17/22; B22D 11/2236; B22D 17/2272; B22D 17/229; B22D 17/24
(Continued)

(56) References Cited

U.S. PATENT DOCUMENTS 3,465,387 A 9/1969 Allard et al.
4,790,739 A 12/1988 Manfredi
(Continued)

FOREIGN PATENT DOCUMENTS

CN 204396832 U 6/2015
CN 204398267 U 6/2015
(Continued)

OTHER PUBLICATIONS

International Search Report (PCT/ISA/210) issued in PCT Application No. PCT/EP2021/073229 dated Nov. 16, 2021 with English translation (four (4) pages).
(Continued)

*Primary Examiner* — Kevin P Kerns
(74) *Attorney, Agent, or Firm* — Crowell & Moring LLP

(57) ABSTRACT

A three-plate pressure die casting mold for producing at least one metallic die casting part by die casting a metal melt, includes first, second and third mold parts and at least one mold cavity as well as a sprue system. In the third mold part there is at least one spring-loaded pressure element which, when opening the die casting mold, presses the sprue produced in the sprue system against the first mold part, whereby the sprue is retained and tears off from the die casting part in a defined manner. A method for pressure die casting using the three-plate pressure die casting mold is disclosed.

10 Claims, 3 Drawing Sheets

(58) Field of Classification Search
USPC ..... 164/265, 339, 342, 344, 137
See application file for complete search history.

(56) References Cited

U.S. PATENT DOCUMENTS

| | | | |
|---|---|---|---|
| 6,139,305 | A | 10/2000 | Nesch |
| 6,558,149 | B1 | 5/2003 | Bodmer et al. |
| 8,602,769 | B2 | 12/2013 | Tseng et al. |
| 10,040,232 | B2 | 8/2018 | Liu et al. |
| 2005/0072550 | A1 | 4/2005 | Nagasaka et al. |
| 2014/0219862 | A1 | 8/2014 | Schirm et al. |
| 2017/0326770 | A1 | 11/2017 | Hirose et al. |

FOREIGN PATENT DOCUMENTS

| | | | |
|---|---|---|---|
| CN | 106001495 | A | 10/2016 |
| DE | 1976720 | U | 1/1968 |
| DE | 1 758 456 | A1 | 1/1971 |
| DE | 2146765 | A1 | 3/1972 |
| DE | 244 315 | A1 | 4/1987 |
| DE | 197 33 667 | A1 | 2/1999 |
| DE | 10 2011 018 255 | B3 | 6/2012 |
| DE | 10 2011 116 254 | B3 | 3/2013 |
| DE | 10 2012 107 363 | A1 | 3/2013 |
| DE | 10 2014 101 107 | A1 | 8/2014 |
| DE | 10 2016 003 031 | A1 | 9/2017 |
| DE | 10 2017 004 375 | A1 | 11/2017 |
| DE | 10 2017 220 410 | A1 | 5/2019 |
| DE | 10 2018 114 990 | A1 | 12/2019 |
| DE | 10 2017 124 150 | B4 | 1/2021 |
| EP | 0 488 508 | A2 | 6/1992 |
| GB | 625185 | A | 6/1949 |
| JP | 58-188638 | A | 11/1983 |
| JP | 9-323143 | A | 12/1997 |
| JP | 2008-178896 | A | 8/2008 |
| WO | WO 99/28108 | A1 | 6/1999 |
| WO | WO 2017/077949 | A1 | 5/2017 |

OTHER PUBLICATIONS

German-language Written Opinion (PCT/ISA/237) issued in PCT Application No. PCT/EP2021/073229 dated Nov. 16, 2021 (five (5) pages).

German-language Search Report issued in German Application No. 10 2020 125 342.7 dated Apr. 29, 2021 with partial English translation (10 pages).

International Search Report (PCT/ISA/210) issued in PCT Application No. PCT/EP2021/073562 dated Nov. 2, 2021 with English translation (five (5) pages).

German-language Written Opinion (PCT/ISA/237) issued in PCT Application No. PCT/EP2021/073562 dated Nov. 2, 2021 (six (6) pages).

German-language Search Report issued in German Application No. 10 2020 125 343.5 dated Apr. 29, 2021 with partial English translation (10 pages).

THREE-PLATE PRESSURE DIE CASTING MOLD HAVING IMPROVED SPRUE SEPARATION, AND METHOD FOR PRESSURE DIE CASTING (II)

BACKGROUND AND SUMMARY

The invention relates to what is referred to as a three-plate die casting mold. The invention also relates to a method for producing at least one metal die-cast part by means of such a three-plate die casting mold.

As is known, during die casting, liquid metal melt is pressed at high pressure into the die cavity of a die casting mold (casting die), where it then solidifies. After the metal melt has solidified, the die casting mold is opened to remove the die-cast part (possibly also multiple die-cast parts) from the die. In order to be able to open and close the die casting mold, it has at least two mold parts (mold halves), with at least one of these mold parts being movable relative to the other mold part. The opening and closing are brought about using a die casting machine, which incorporates the die casting mold.

A die casting mold usually also has a sprue system which is formed by feed channels, distribution points, overflow points and/or the like, and via which the liquid metal melt enters the die cavity or is fed to the die cavity. The metal melt that has solidified in the sprue system is referred to as sprue. The sprue is separated from the actual die-cast part (shaped part) and disposed of as waste or recycled.

The prior art also discloses what are referred to as three-plate die casting molds, as described for example in the patent document DE 10 2012 107 363 A1. Such a three-plate die casting mold has a third mold part which is in the form of an intermediate plate, as it were, and is arranged so as to be movable between a first, typically stationary mold part, which in particular is on what is referred to as the sprue side, and a second, movable mold part, with the result that there are two mold parting planes. When the three-plate die casting mold is being opened, the die-cast part is pulled away from the sprue by the opening movement of the third mold part (intermediate plate), as a result of which the die-cast part and the sprue are forcibly parted (what is referred to as sprue separation) in that the sprue tears off from the die-cast part, or the die-cast part tears off from the sprue. The die-cast part can then be removed from the die by way of the first mold parting plane between the second mold part and the third mold part, and the sprue can be removed from the die by way of the second mold parting plane between the first mold part and the third mold part.

The three-plate die casting mold according to the invention of the independent claims has improved, very effective sprue separation, it then furthermore also being the case that the sprue can be removed from the die more easily. The additional independent patent claim expands the invention also to a method for producing at least one metal die-cast part by means of a three-plate die casting mold according to the invention, or using a three-plate die casting mold according to the invention. Additional features of the invention will become similarly apparent for the two subjects of the invention from the dependent patent claims, the following description of the invention, and the figures.

The three-plate die casting mold (also referred to simply as die casting mold below) according to the invention for producing at least one metal die-cast part by die casting a metal melt comprises a first, a second and a third mold part (mold plates), wherein the third mold part (intermediate plate) is arranged between the first and the second mold part. The die casting mold according to the invention further comprises at least one die cavity (in which the die-cast part to be produced is created) and also a sprue system, through which the metal melt is fed, or can be fed, to the die cavity. When this die casting mold is being opened, the sprue created in the sprue system is separated, or torn off, from the die-cast part created in the die cavity, with the die-cast part then being able to be removed, or being removed, from the die by way of a first mold parting plane between the second mold part and the third mold part, and the sprue being able to be removed, or being removed, from the die by way of a second mold parting plane between the first mold part and the third mold part.

According to the invention, in the third mold part there is arranged at least one spring-pretensioned pressing element, which is in particular formed in the manner of a punch and which, when the die casting mold is being opened in, or inside, the second mold parting plane, presses, or clamps, the sprue against the first mold part, as a result of which the sprue is retained and (thereby) tears off, or can tear off, from the die-cast part in a defined manner. In other words: In the third mold part there is arranged at least one spring-pretensioned pressing element, by means of which, when the die casting mold is being opened in the second mold parting plane, the sprue can be pressed, or is pressed, against the first mold part, in order to bring about or at least to promote defined tearing off (of the sprue) from the die-cast part. Preferably, multiple such spring-pretensioned pressing elements are provided. (The following explanations, without limiting the invention, relate to one spring-pretensioned pressing element.)

In the case of the three-plate die casting mold according to the invention, the sprue is retained, or held in position, by means of the at least one spring-pretensioned pressing element when the die casting mold is being opened (that is to say, during the opening movement), in that the sprue is clamped, in particular at certain points, or at certain locations, against the first mold part, as it were, at least until the sprue tears off from the die-cast part, with what is referred to as the tear-off travel being substantially determined by the elongation properties of the sprue. This ensures or at least assists defined and accurately repeatable tearing off of the sprue from the die-cast part at a determined point in time during the opening movement and/or at a determined relative position between the third mold part and the first mold part. The retention is effected without an undercut contour or the like, this moreover simplifying, or facilitating, the removal of the sprue from the die, or the ejection of the sprue, with the result that the arrangement of ejectors, or pushers, such as ejector pins or the like, is also less restrictive. The sprue system can also have a more complex configuration, for example such that multiple feed channels, which lead to a die cavity or possibly also to multiple die cavities, are provided in different mold planes and/or with different alignments (for example horizontal and vertical).

Preferably, the spring-pretensioned pressing element is arranged so as to be relatively movable with respect to a main body or the like of the third mold part, in particular in such a way that the pressing element can move parallel to the opening direction, or closing direction, of the die casting mold.

Preferably, the third mold part is formed with a pocket, that is to say with a recess or a depression or the like, in which the spring-pretensioned pressing element is arranged. This pocket is located in particular in a surface of the third mold part that faces toward the first mold part.

The spring-pretensioned pressing element is preferably a movable, in particular longitudinally movable, punch which can retain, or clamp, the sprue, in particular at certain points, or at certain locations. Preferably, a punch guide for the movable punch and a spring device, which pretensions the punch toward the first mold part, or toward the sprue, are furthermore also provided. Preferably, the pressing element, or the punch, the punch guide and the spring device form a punch mechanism, which in particular is arranged in a pocket (as explained above). Preferably, the punch guide has a guide bolt or the like, on which the pressing element, or the punch, is longitudinally movably guided, or mounted. The spring device is preferably a disk spring set which comprises multiple disk springs and in particular is arranged around the guide bolt, or on the guide bolt. The compressive force that can be generated by the spring device is in particular dimensioned such that the sprue is reliably retained, that is to say the compressive force generated is larger than the tensile force acting on the sprue when the die casting mold is being opened.

Preferably, at least one stop, which delimits the travel of the pressing element, or of the punch, toward the first mold part and in particular also prevents it from falling out is provided. The travel of the pressing element, or the punch travel, is in particular dimensioned such that the sprue is retained, or clamped against the first mold part, at least until it tears off from the die-cast part, in order to ensure reliable sprue separation.

Preferably, the pressing element, or the punch, in particular on its end face, has (at least) one portion, in particular a surface portion, which comes into touching contact with the first mold part when the die casting mold is being closed and via which a restoring force can be applied, or is applicable, by the first mold part, in order in particular to push the pressing element, or the punch, back into the pocket and also to tension the spring device. Two preferred possible embodiments will be explained in more detail below.

The sprue system of the die casting mold according to the invention may have multiple (but at least one) feed channels, which are arranged in the third mold part, lead into the die cavity, and, at their die-cavity-side ends, that is to say in the region in which they lead into the die cavity, are each formed with a tapering which locally reduces, or locally narrows, the (respective) channel cross section and which makes it possible to create predetermined breaking points during the die casting operation at which the sprue tears off from the die-cast part. That is to say, the predetermined breaking points make it possible, when the die casting mold is being opened, to tear off the sprue from the die-cast part in a defined manner in terms of the parting points, or tear-off points, with the tearing off being effected in particular directly at the die-cast part. In interaction with the retention, or holding back, of the sprue that was explained above, this results in very effective sprue separation. Furthermore, the casting reworking of the die-cast part is made less complex. In addition, the mechanical loading of the die casting mold is decreased and the mold wear is reduced as a result.

Preferably, the feed channels in the third mold part that lead into the mold cavity have a conical, preferably cone-shaped form, in particular with cross sections that become smaller toward the mold cavity, and, in addition to this conical form, at their die-cavity-side ends are each formed with a tapering which locally reduces, or locally narrows, the channel cross section.

Preferably, the taperings at the die-cavity-side ends of the feed channels in the third mold part that lead into the die cavity are formed by a bead, or annular bead, or the like, each of which runs around the periphery, preferably around the entire periphery, in particular is shaped in collar-like fashion, and is arranged in particular in the opening cross section and locally narrows the respective feed channel in the opening cross section. This makes it possible to create, or shape, an annular-groove-like, in particular annular-notch-like, predetermined breaking point at the respective transition between the sprue, or a sprue web, and the die-cast part.

Preferably, the feed channels in the third mold part that lead into the die cavity are aligned perpendicularly or at least substantially perpendicularly to the die cavity. That is to say, the feed channels lead perpendicularly or at least substantially perpendicularly into the die cavity. This relates in particular to a die cavity for producing a thin-walled and/or sheet-like die-cast part, the feed channels being aligned perpendicularly to an areal extent of the die-cast part to be produced.

The method according to the invention for producing at least one metal die-cast part comprises at least the following steps:

- providing a three-plate die casting mold according to the invention, which in particular is incorporated in a die casting machine;
- closing the die casting mold and carrying out a die casting operation, with liquid metal melt being pressed into the die cavity (or into the die cavities) through the sprue system;
- opening the die casting mold after the metal melt has solidified, with the sprue created in the sprue system being pressed against the first mold part by the at least one spring-pretensioned pressing element in, or inside, the second mold parting plane (during the opening movement) and is separated, or tears off, from the die-cast part in particular at least at one predetermined breaking point (see above);
- if appropriate, removing the die-cast part and the sprue from the die.

Preferably, when it is being opened, the die casting mold is opened first of all in the second mold parting plane between the third mold part (intermediate plate) and the first, in particular stationary, mold part (nozzle plate), in which also the sprue is removed from the die. In this context, the sprue can be separated, or tear off, from the die-cast part already at the start of the opening operation, that is to say at the start of the opening movement of the third mold part, which in particular is effected together with the second mold part.

The die-cast part to be produced is preferably a vehicle component, in particular a thin-walled and/or sheet-like light metal bodywork component, such as a longitudinal member element.

The invention will be explained in more detail below in relation to the figures and with reference to a particularly preferred possible embodiment (best mode). The features that are shown in the figures and/or explained below may be general features of the invention and correspondingly develop the invention also independently of specific combinations of features.

DETAILED DESCRIPTION OF THE DRAWINGS

Figure 1:
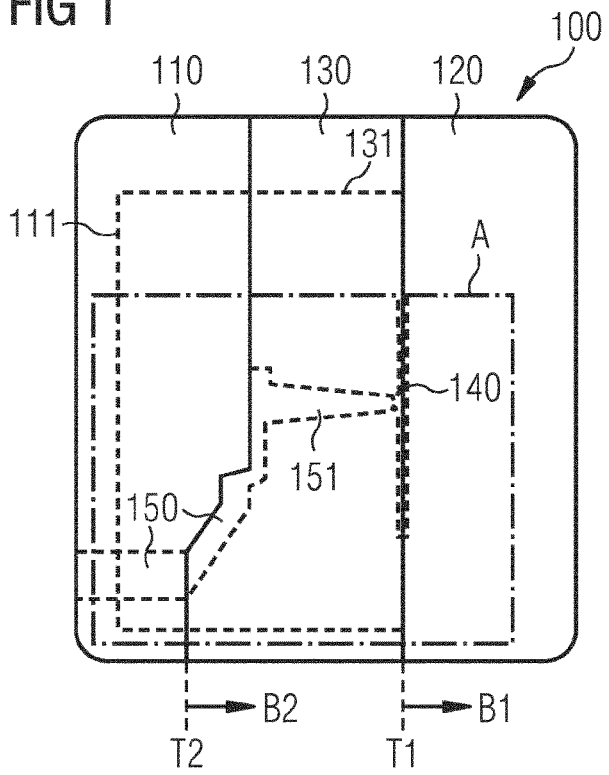
FIG. 1 schematically shows a three-plate die casting mold according to an embodiment of the invention.

The three-plate die casting mold 100 shown in FIG. 1 is incorporated in a die casting machine, which is not shown, and comprises a first, in particular stationary, mold part 110 (first mold plate), a second, movable mold part 120 (second mold plate) and a third mold part 130 (third mold plate), which is arranged between the first mold part 110 and the second mold part 120 and likewise is movable. The first mold part 110 and the third mold part 130 may optionally have sprue plates 111, 131 in the form of inserts. The die casting mold 100 also comprises a die cavity 140, for example for producing a thin-walled light metal bodywork component, and a sprue system 150, through which liquid metal melt (for example aluminum melt or magnesium melt) enters, or is pressed into, the die cavity 140. The sprue system 150 can, for example, have a similar configuration to that described in DE 10 2012 107 363 A1. (In the figures, and nonlimitingly, only one die cavity 140 is illustrated, it also being possible for a three-plate die casting mold 100 according to the invention to have multiple die cavities.)

The three-plate die casting mold 100 advantageously makes it possible to feed the metal melt to the die cavity 140 laterally, and substantially perpendicularly with respect to an areal extent of the die-cast part to be produced. To that end, the sprue system 150 has multiple conical, and thus nozzle-shaped, feed channels 151 (also referred to as gates), which are arranged in the third mold part 130, or formed in the third mold part 130, and which lead, in particular substantially perpendicularly, into the die cavity 140. (In the figures, and nonlimitingly, only one of the feed channels 151 is illustrated, the explanations below referring to this one feed channel 151. A three-plate die casting mold 100 according to the invention may have multiple such feed channels 151 or only one such feed channel 151.)

There is a first mold parting plane T1 between the second mold part 120 and the third mold part 130, and a second mold parting plane T2 between the third mold part 130 and the first mold part 110. These mold parting planes T1, T2 are not planar surfaces in the mathematical sense, but complexly shaped mold parting points that are, however, referred to as mold parting planes. Moving, or displacing, the second mold part 120 and the third mold part 130, as depicted by the arrows B1, B2, makes it possible to open the die casting mold 100 at the mold parting planes T1, T2. Then, the die-cast part created in the die cavity 140 by the solidified metal melt can be removed from the die by way of the first mold parting plane T1, and the sprue created in the sprue system 150 by the solidified metal melt can be removed from the die by way of the second mold parting plane T2, as explained in more detail below with reference to FIGS. 2 to 4.

Figure 2:
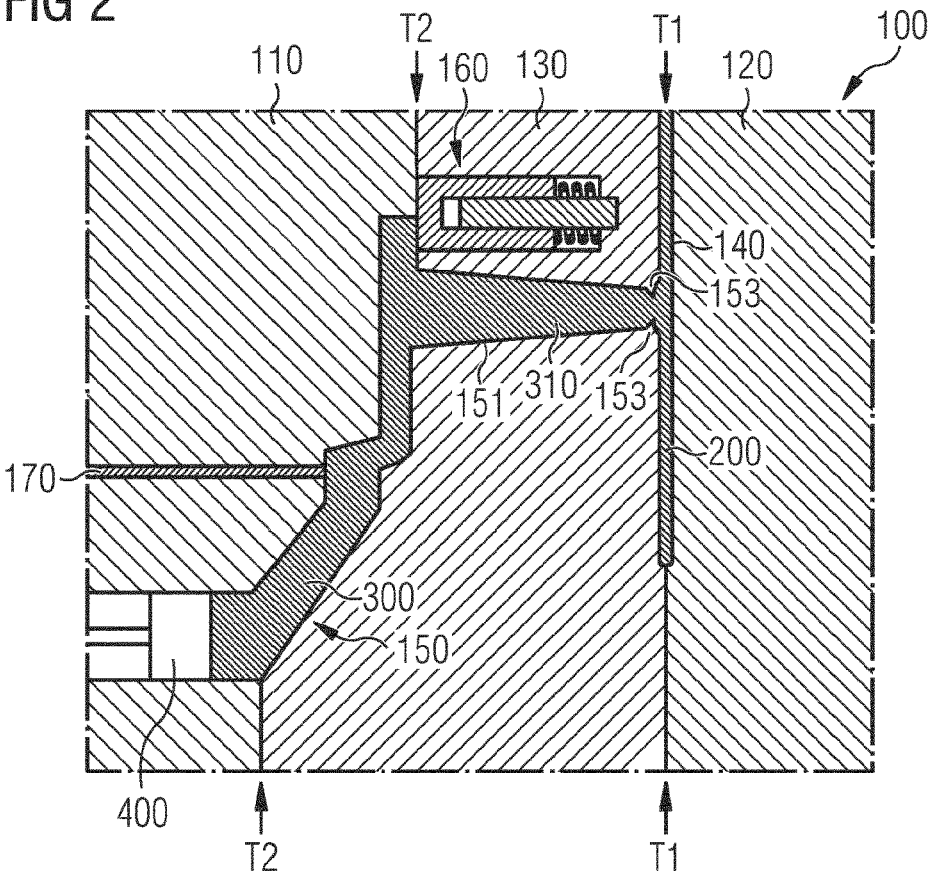
FIGS. 2 to 4 schematically depict the mode of operation of the die casting mold of FIG. 1 with reference to a mold detail selected by way of example (according to the region A identified in FIG. 1).

FIG. 2 shows the situation after the cavity 140 has been filled with liquid metal melt by way of the sprue system 150, with the die casting mold 100 closed. The metal melt solidifies in the die cavity 140 to form a die-cast part 200 and in the sprue system 150 to form what is referred to as a sprue 300, what is referred to as a sprue web 310 forming in the feed channel 151 of the sprue system 150.

Figure 3:
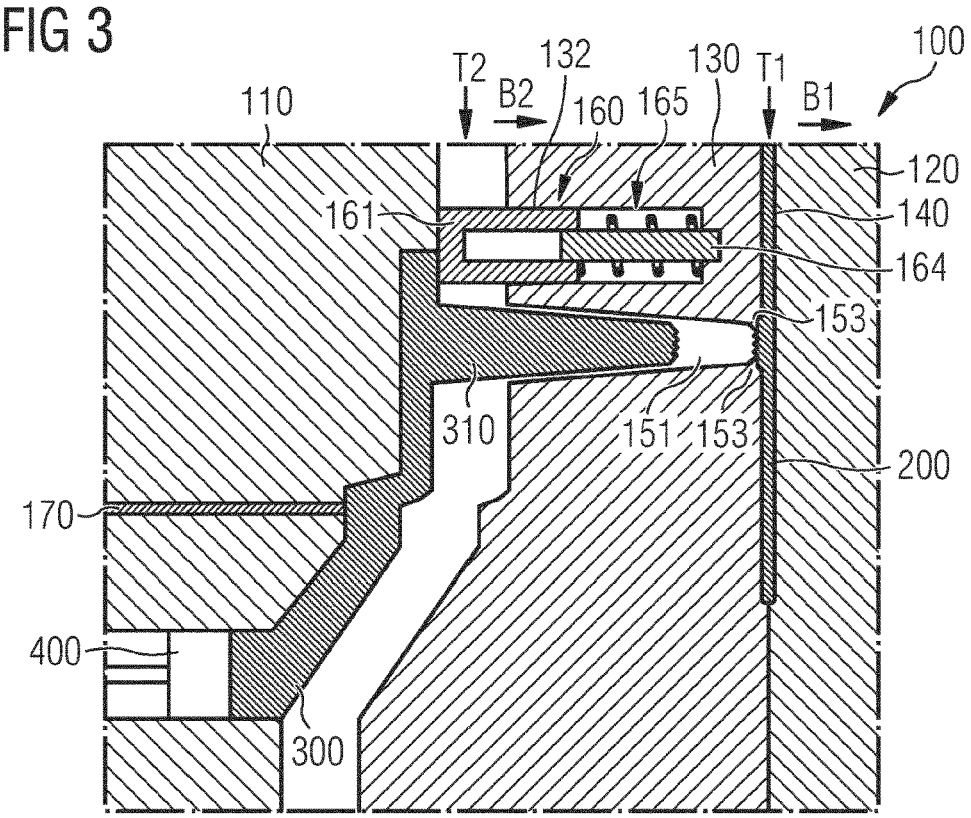

After the metal melt has solidified, the die casting mold 100 is firstly opened in the second mold parting plane T2, as depicted in FIG. 3. Here, the sprue 300 is pressed against the first mold part 110 by means of at least one spring-pretensioned pressing element 161, which is arranged so as to be relatively movable in the third mold part 130, as a result of which the sprue 300 is clamped in, as it were, and retained at certain points, and owing to the opening movement B2 is separated, or tears off, from the die-cast part 200. The spring-pretensioned pressing element 161 positions the sprue 300 in a defined manner for the sprue separation and the subsequent ejection operation.

The pressing element 161 is in the form of a movable punch and is a constituent part of a punch mechanism 160. The punch mechanism 160 comprises the movable punch 161, a guide bolt 164 acting as a punch guide, and a spring device 165, which pretensions the punch 161 toward the first mold part 110, or toward the sprue 300. The punch 161 is longitudinally movably mounted on the guide bolt 164, the movement axis being oriented parallel to the opening movement B1/B2, that is to say horizontally. The spring device 165 is in particular in the form of a disk spring set. The punch mechanism 160 is arranged in a pocket 132 of the third mold part 130. The pocket 132 may be produced by machining, for example by milling, with it being possible for the pocket 132 to be arranged in a main body of the third mold part 130 or in a sprue plate (see reference sign 131 in FIG. 1), the latter simplifying the manufacture. (Nonlimitingly, only one punch mechanism 160 which is positioned by way of example is illustrated in the figures, it being possible for multiple such punch mechanisms 160 arranged at suitable locations to be provided.)

The feed channel 151, formed in the third mold part 130, of the sprue system 150 has, at its die-cavity-side end, a tapering 153 that locally decreases the channel cross section. (The same applies in particular also for the other feed channels 151 in the third mold part 130 that lead into the die cavity 140.) In the opening cross section 152 to the die cavity 140, the tapering 153 is in the form of a bead or the like that runs around the periphery, in particular that is shaped in collar-like fashion (as can be seen in particular in FIG. 4). The local tapering 153 creates an annular-groove-like, in particular annular-notch-like, predetermined breaking point between the die-cast part 200 and the sprue 300 during the die casting operation, at which predetermined breaking point the sprue 300 is separated, or torn off, from the die-cast part 200 in a defined manner (and specifically directly at the die-cast part 200) already just after the start of the opening movement B2 of the third mold part 130, with the sprue 300 and its sprue web 310 being retained by means of the spring-pretensioned pressing element, or punch, 161, thereby ensuring defined separation, or tearing off. Only a small, flash-free tear-off point 210 remains on the die-cast part 200.

Figure 4:
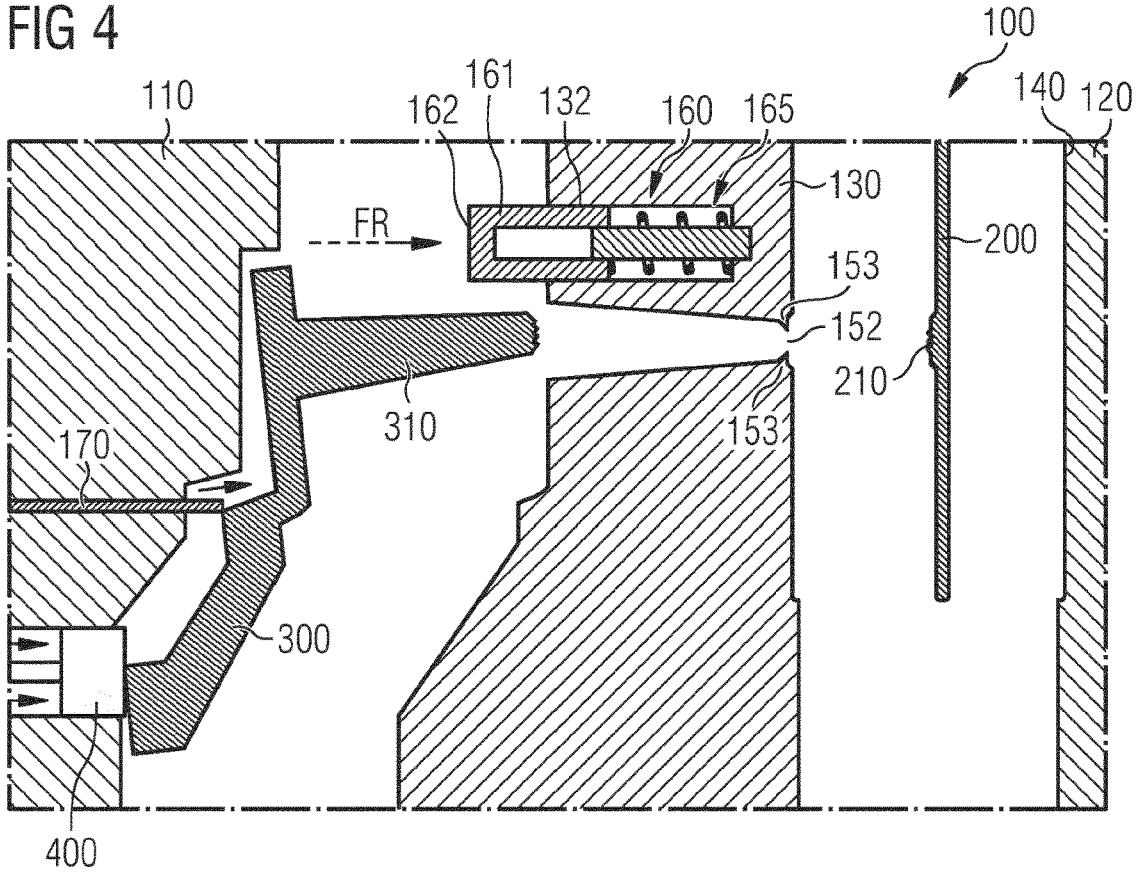

The travel, or movement travel, of the punch-like pressing element 161 toward the first mold part 110 is delimited by a mechanical stop (see FIGS. 5 and 6), with the result that the punch 161, in the course of the further opening movement B2, lifts off from the sprue 300 and releases it (as shown in FIG. 4). After the die casting mold 100 has completely opened (as shown in FIG. 4), the die-cast part 200 and the sprue 300 can be removed from the die. The removal of the sprue 300 from the die is effected by means of at least one ejector 170 in the first mold part 110, and optionally also by means of the casting piston 400 that is part of the die casting machine and ejects the butt. Ejectors, which are not shown, can likewise be provided to remove the die-cast part 200 from the die.

The punch 161 acting as pressing element has, on its end face (or at some other suitable location), a portion 162 which comes into touching contact with the first mold part 110 when the die casting mold 100 is being closed, with the result that a restoring force FR which pushes the punch 161 back into the pocket 132 is applied, the spring device 165 also being tensioned at the same time.

FIG. 5*a* shows (without structural detail) a first embodiment of a spring-pretensioned pressing element 161, which substantially corresponds to the embodiment shown in FIGS. 1 to 4, with the die casting mold 100 in the closed state. What is illustrated here is also a stop 166, which delimits the travel of the pressing element, or of the punch, 161 and also prevents the punch 161 from falling out. The punch travel, or punch stroke, that is enabled must correspond at least to the opening travel, or the tear-off travel, of the third mold part 130 until tearing off occurs and is in particular greater than the tear-off travel. The end face of the punch 161 is in particular dimensioned such that an admissible surface pressure is not exceeded. (The end face of the punch 161 may, for example, have a diameter of up to 100 mm and more, taking into account the compressive force to be applied and the admissible surface pressure.) The ejector 170, which is in the form of an ejector pin, is arranged in the region of the feed channel 151, or of the sprue web 310, here (by contrast to FIGS. 1 to 4). FIG. 5*b* shows the end face of the punch 161, it also being possible for the punch 161 to have a different cross-sectional shape. The portion 162 for applying the restoring force FR is illustrated in hatched lines.

Figure 5:
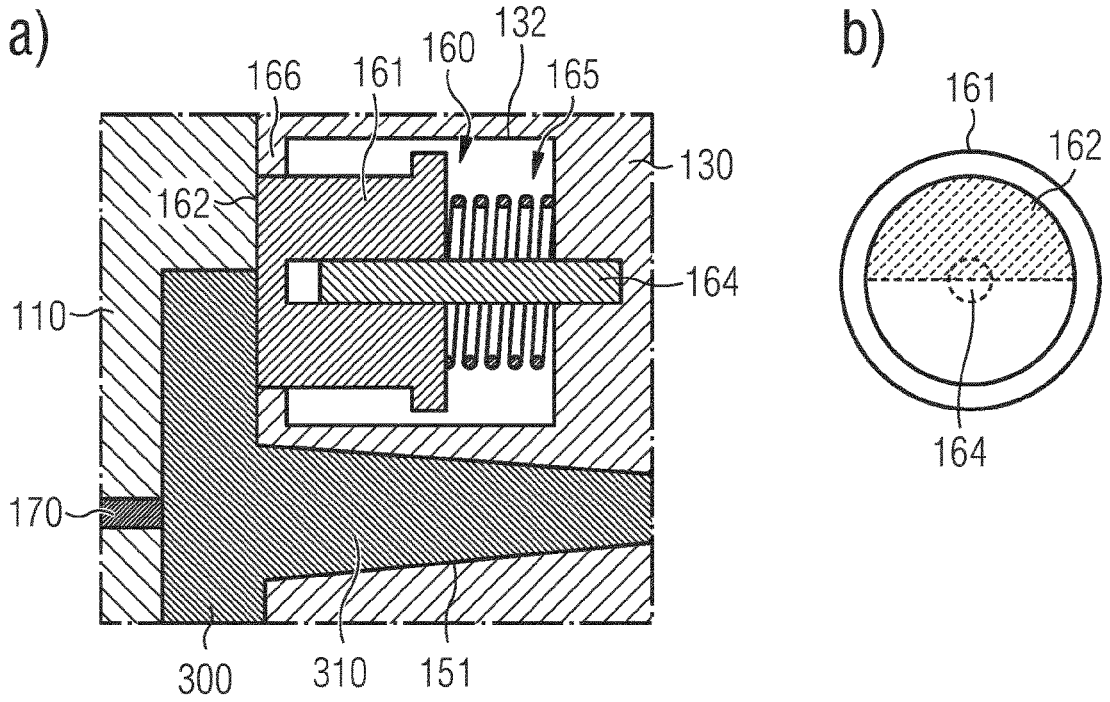
FIG. 5 schematically shows a preferred first possible embodiment of a pressing element for the die casting mold of FIGS. 1 to 4.
Figure 6:
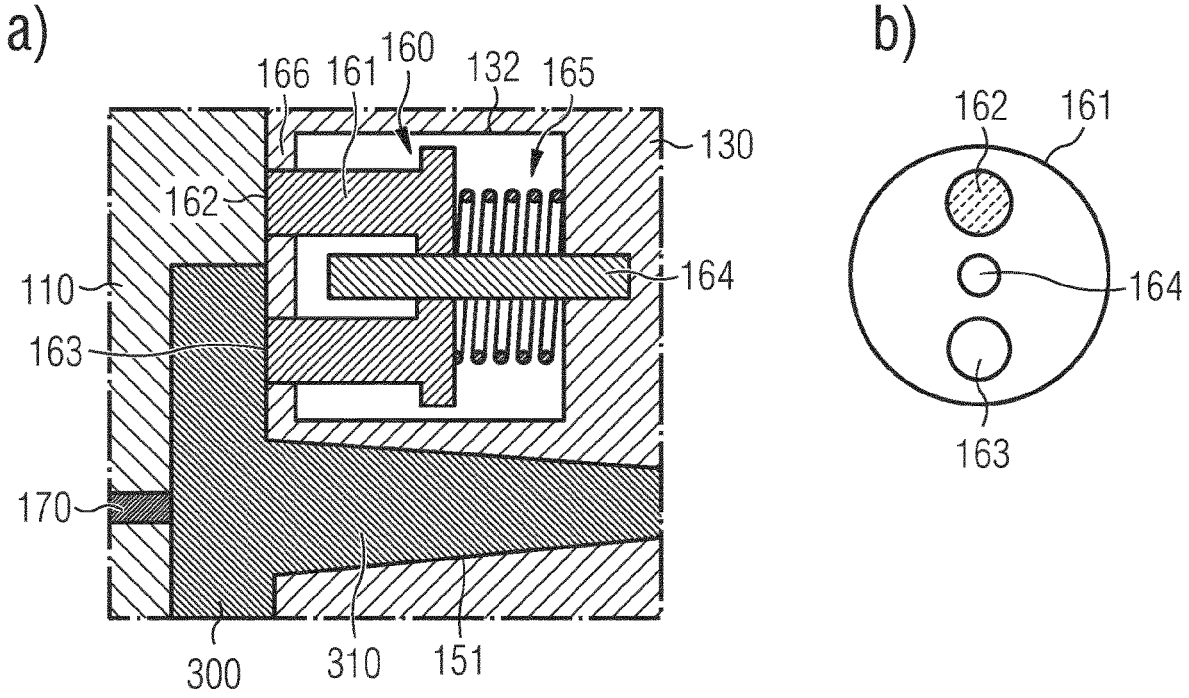
FIG. 6 schematically shows an alternative second possible embodiment of a pressing element for the die casting mold of FIGS. 1 to 4.

FIG. 6 shows, analogously to FIG. 5 (without structural detail), a second embodiment of a spring-pretensioned pressing element 161. The pressing element, or the punch 161, has two portions on its end face. The portion 163 at the bottom in the illustration is intended to retain the sprue 300 and the top portion 162, illustrated in hatched lines, is intended to apply the restoring force FR. In other words: the punch 161 has two arms, with the one (bottom) arm acting as retaining arm, or clamping arm, and the other (top) arm acting as restoring arm.

LIST OF REFERENCE SIGNS

100 Three-plate die casting mold
110 First mold part (nozzle plate)
111 Sprue plate
120 Second mold part (closing plate)
130 Third mold part (intermediate plate)
131 Sprue plate
132 Pocket
140 Die cavity
150 Sprue system
151 Feed channel
152 Opening cross section
153 Local tapering
160 Punch mechanism
161 Punch (pressing element)
162 Portion
163 Portion
164 Guide bolt
165 Spring device
166 Stop
170 Ejector
200 Die-cast part
210 Tear-off point
300 Sprue
310 Sprue web
400 Casting piston
A Region
B1 Opening movement
B2 Opening movement
FR Restoring force
T1 First mold parting plane
T2 Second mold parting plane

The invention claimed is:

1. A three-plate die casting mold for producing at least one metal die-cast part by die casting a metal melt, the die casting mold comprising:

a first, a second, and a third mold part, with the third mold part being arranged between the first and the second mold parts;

at least one die cavity;

a sprue system, through which the metal melt is fed to the at least one die cavity; and at least one spring-pretensioned pressing element arranged in the third mold part, wherein:

when the die casting mold is being opened, a sprue created in the sprue system is torn off from the at least one metal die-cast part created in the at least one die cavity and the at least one metal die-cast part is removable by way of a first mold parting plane between the second mold part and the third mold part, and the sprue is removable by way of a second mold parting plane between the first mold part and the third mold part, and when the die casting mold is being opened in the second mold parting plane, the at least one spring-pretensioned pressing element in the third mold part presses the sprue against the first mold part, whereby the sprue is retained and tears off from the at least one metal die-cast part in a defined manner.

2. The three-plate die casting mold according to claim 1, wherein the third mold part is formed with a pocket, in which the at least one spring-pretensioned pressing element is arranged.

3. The three-plate die casting mold according to claim 1, wherein the at least one spring-pretensioned pressing element is a movable punch, wherein a punch guide for the movable punch and a spring device, which pretensions the movable punch toward the first mold part, are provided.

4. The three-plate die casting mold according to claim 3, wherein the punch guide has a guide bolt, on which the punch is longitudinally movably mounted.

5. The three-plate die casting mold according to claim 3, wherein the spring device is a disk spring set.

6. The three-plate die casting mold according to claim 3, wherein a stop, which delimits a travel of the punch toward the first mold part, is provided.

7. The three-plate die casting mold according to claim 3, wherein the punch has a portion which comes into contact with the first mold part when the die casting mold is being closed and in which a restoring force is applied.

8. The three-plate die casting mold according to claim 1, wherein the sprue system has multiple feed channels, which are arranged in the third mold part, lead into the at least one die cavity, and, at their die-cavity-side ends, are each formed with a tapering which locally reduces a channel cross section and which creates a predetermined breaking point during a die casting operation at which the sprue tears off from the at least one metal die-cast part.

9. A method for producing at least one metal die-cast part, comprising:

providing a three-plate die casting mold comprising;

a first, a second, and a third mold part, with the third mold part being arranged between the first and the second mold parts;

at least one die cavity;

a sprue system, through which a metal melt is fed to the at least one die cavity; and at least one spring-pretensioned pressing element arranged in the third mold part, wherein a first mold parting plane is between the second mold part and the third mold part, and a second mold parting plane is between the first mold part and the third mold part;

closing the die casting mold and carrying out a die casting operation, with metal melt being pressed into the at least one die cavity through the sprue system;

opening the die casting mold after the metal melt has solidified, with a sprue created in the sprue system being pressed against the first mold part by the at least one spring-pretensioned pressing element in the second mold parting plane and tearing off from the at least one metal die-cast part.

10. The method according to claim 9, wherein the at least one metal die-cast part to be produced is a vehicle component.

* * * * *